US012752821B2

(12) United States Patent
Chouno et al.

(10) Patent No.: US 12,752,821 B2
(45) Date of Patent: Oct. 6, 2026

(54) RAIL VEHICLE

(71) Applicant: HITACHI, LTD., Tokyo (JP)

(72) Inventors: Takahiro Chouno, Tokyo (JP); Yuuki Hashimoto, Tokyo (JP); Yoshiaki Sugii, Tokyo (JP); Rikuto Yatabe, Tokyo (JP); Hiroki Tsunoda, Aichi (JP); Kazuya Seto, Aichi (JP)

(73) Assignee: HITACHI, LTD., Tokyo (JP)

( * ) Notice: Subject to any disclaimer, the term of this patent is extended or adjusted under 35 U.S.C. 154(b) by 378 days.

(21) Appl. No.: 18/596,865

(22) Filed: Mar. 6, 2024

(65) Prior Publication Data

US 2024/0300553 A1 Sep. 12, 2024

(30) Foreign Application Priority Data

Mar. 8, 2023 (JP) ..... 2023-035352

(51) Int. Cl.
*B61D 37/00* (2006.01)
*B61D 29/00* (2006.01)

(52) U.S. Cl.
CPC ..... *B61D 37/003* (2013.01); *B61D 29/00* (2013.01)

(58) Field of Classification Search
CPC ..... G03B 21/60; B61D 29/00; B61D 37/003
See application file for complete search history.

(56) References Cited

U.S. PATENT DOCUMENTS 4,639,106 A * 1/1987 Gradin ..... H04N 9/3141 348/E5.143
8,608,317 B2 * 12/2013 Babst ..... H04N 9/3147 353/74
11,415,873 B2 * 8/2022 Simoni ..... B61D 25/00

FOREIGN PATENT DOCUMENTS

EP 4008598 A1 * 6/2022 ..... G03B 29/00
JP 2021046122 A * 3/2021

* cited by examiner

*Primary Examiner* — Scott A Browne
(74) *Attorney, Agent, or Firm* — Foley & Lardner LLP

(57) ABSTRACT

Provided is a rail vehicle including a projector-type in-vehicle display device that is provided with a projector and a projection surface, the rail vehicle including the in-vehicle display device that can prevent a crew or the like who walks on a passage between seats from blocking a projection image, that provides good visibility for a passenger or the like, and that has a light weight. A rail vehicle includes a roof structure serving as a roof of the rail vehicle, a side structure serving as a side surface of the rail vehicle, a luggage rack portion provided along a longitudinal direction of the rail vehicle on a vehicle inner side of the rail vehicle at an upper end portion of the side structure, a projector provided in the luggage rack portion, and a ceiling film provided on a vehicle inner side of the roof structure and serves as a projection surface onto which an image is projected from the projector.

6 Claims, 7 Drawing Sheets

RAIL VEHICLE

CROSS-REFERENCE TO RELATED APPLICATIONS

The present application claims priority to Japanese Patent Application No. 2023-035352, filed Mar. 8, 2023. The contents of this application are incorporated herein by reference in their entirety.

TECHNICAL FIELD

The present invention relates to a rail vehicle.

BACKGROUND ART

A rail vehicle operated along a laid track generally has a hexahedral rail vehicle structure including an underframe that forms a floor surface, end structures erected on both end portions in a longitudinal direction of the underframe, side structures erected on both end portions in a width direction of the underframe, and a roof structure placed on upper end portions of the end structures and the roof structure. An upper floor is provided on an upper surface of the underframe, and a seat or the like is provided on an upper surface of the upper floor. A heat insulating material and a sound insulating material are provided on a vehicle inner side of the side structures and the roof structure, and interior materials such as a side material and a ceiling material are provided in a manner of covering the heat insulating material and the sound insulating material, thereby providing a comfortable vehicle interior environment.

Generally, an in-vehicle display that provides various kinds of information to a passenger and the like who board a rail vehicle is provided on an upper portion of an inner end having a through door at an end portion in a longitudinal direction of the rail vehicle.

To provide an in-vehicle display device that can increase an amount of displayable information and can prevent passengers who pass through a passage from blocking a projection image, PTL 1 discloses a railway vehicle including an in-vehicle display device provided with a projector that projects an image with a vehicle inner side surface of the railway vehicle as a projection surface. The projection surface is provided on an end surface of the railway vehicle, a through passage is provided on the end surface, and a plurality of projectors are disposed on a vehicle inner side surface in a width direction of the railway vehicle in a manner of not overlapping the through passage as viewed from a longitudinal direction of the railway vehicle, and are disposed between the end surface and a seat closest to the end surface as viewed from the width direction of the railway vehicle.

CITATION LIST

Patent Literature

PTL 1: JP2021-46122A

SUMMARY OF INVENTION

Technical Problem

According to PTL 1, it is desirable to provide a large display unit so that a passenger who is seated on a seat on one end portion in a longitudinal direction of a rail vehicle and is away from an in-vehicle display device can visually see the in-vehicle display device provided at the other end portion in the longitudinal direction.

However, since the in-vehicle display device is provided in a space between an upper end portion of a through passage door and a ceiling, an increase in a size of a display unit of the in-vehicle display device is limited due to the limitation of a vehicle body. Further, a weight and costs of the in-vehicle display device having a large display unit tend to increase.

Therefore, instead of the in-vehicle display device in the related art, an in-vehicle display device including a projector is studied, in which the projector projects various kinds of information on an inner end or a ceiling and transmits the information to a passenger.

An object of the invention is to provide a rail vehicle including a projector-type in-vehicle display device that is provided with a projector and a projection surface, the rail vehicle including the in-vehicle display device that can prevent a crew or the like who walks on a passage between seats from blocking a projection image, that provides good visibility for a passenger or the like, and that has a light weight.

Solution to Problem

In order to solve the above problem, a typical rail vehicle according to the invention includes:

- a roof structure serving as a roof of the rail vehicle;
- a side structure serving as a side surface of the rail vehicle;
- a luggage rack portion provided along a longitudinal direction of the rail vehicle on a vehicle inner side of the rail vehicle at an upper end portion of the side structure;
- a projector provided in the luggage rack portion; and
- a ceiling film provided on a vehicle inner side of the roof structure and serves as a projection surface onto which an image is projected from the projector.

Advantageous Effects of Invention

According to the invention, it is possible to provide a rail vehicle including a projector-type in-vehicle display device that is provided with a projector and a projection surface, the rail vehicle including the in-vehicle display device that can prevent a crew or the like who walks on a passage between seats from blocking a projection image, that provides good visibility for a passenger or the like, and that has a light weight.

Problems, configurations, and effects other than those described above will become apparent by description of the following embodiments.

DESCRIPTION OF EMBODIMENTS

Hereinafter, embodiments of a rail vehicle according to the invention will be described with reference to the drawings. First, directions are defined in order to describe a configuration of a rail vehicle. A longitudinal direction of the rail vehicle is defined as an x direction, a width direction of the rail vehicle is defined as a y direction, and a height direction of the rail vehicle is defined as a z direction. Hereinafter, directions may be simply referred to as the x direction, the y direction, and the z direction.

The rail vehicle is a vehicle operated along a laid track, and includes a railway vehicle, a monorail vehicle, a new transportation system vehicle, a streetcar, or the like. Hereinafter, a railway vehicle will be described as a representative example of a rail vehicle.

Figure 1:
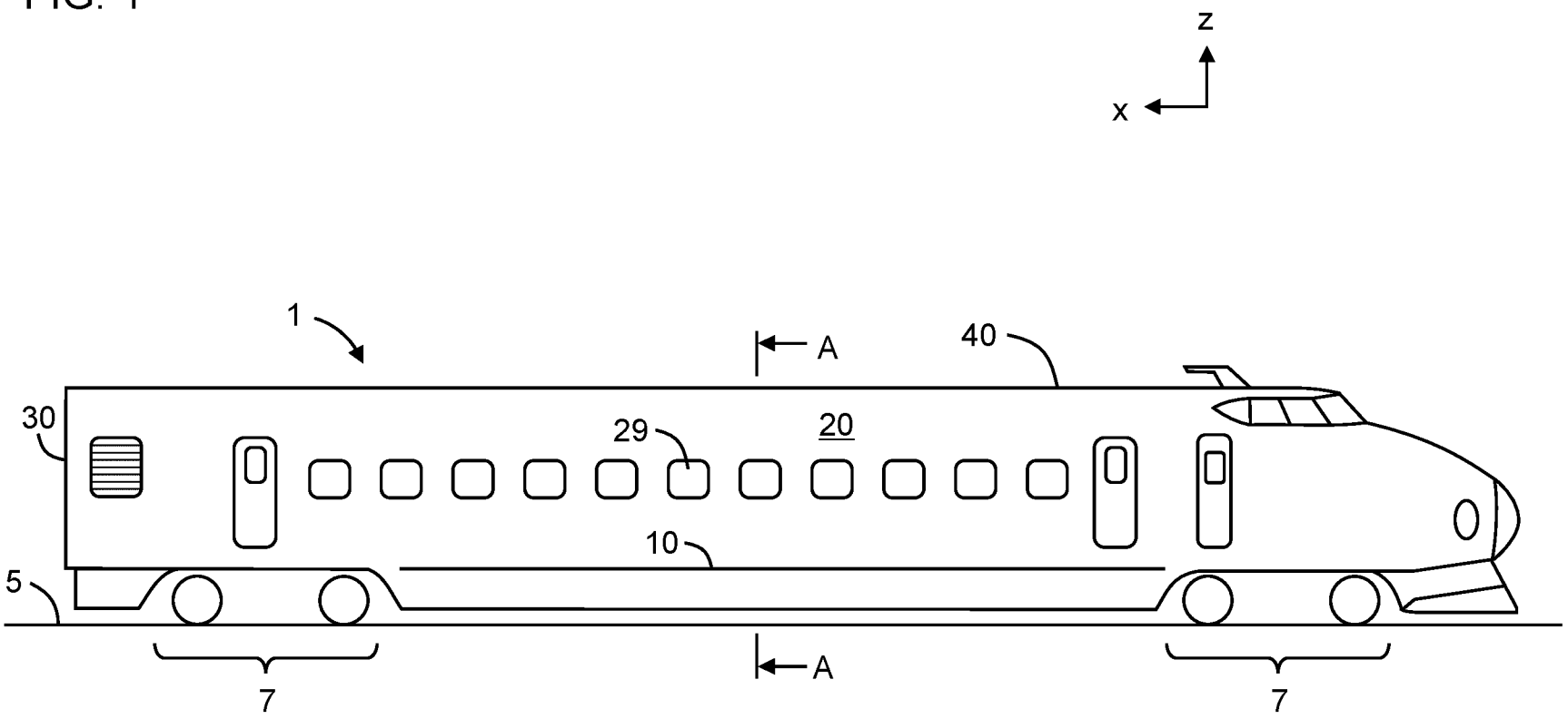
FIG. 1 is a side view showing a railway vehicle.
Figure 2:
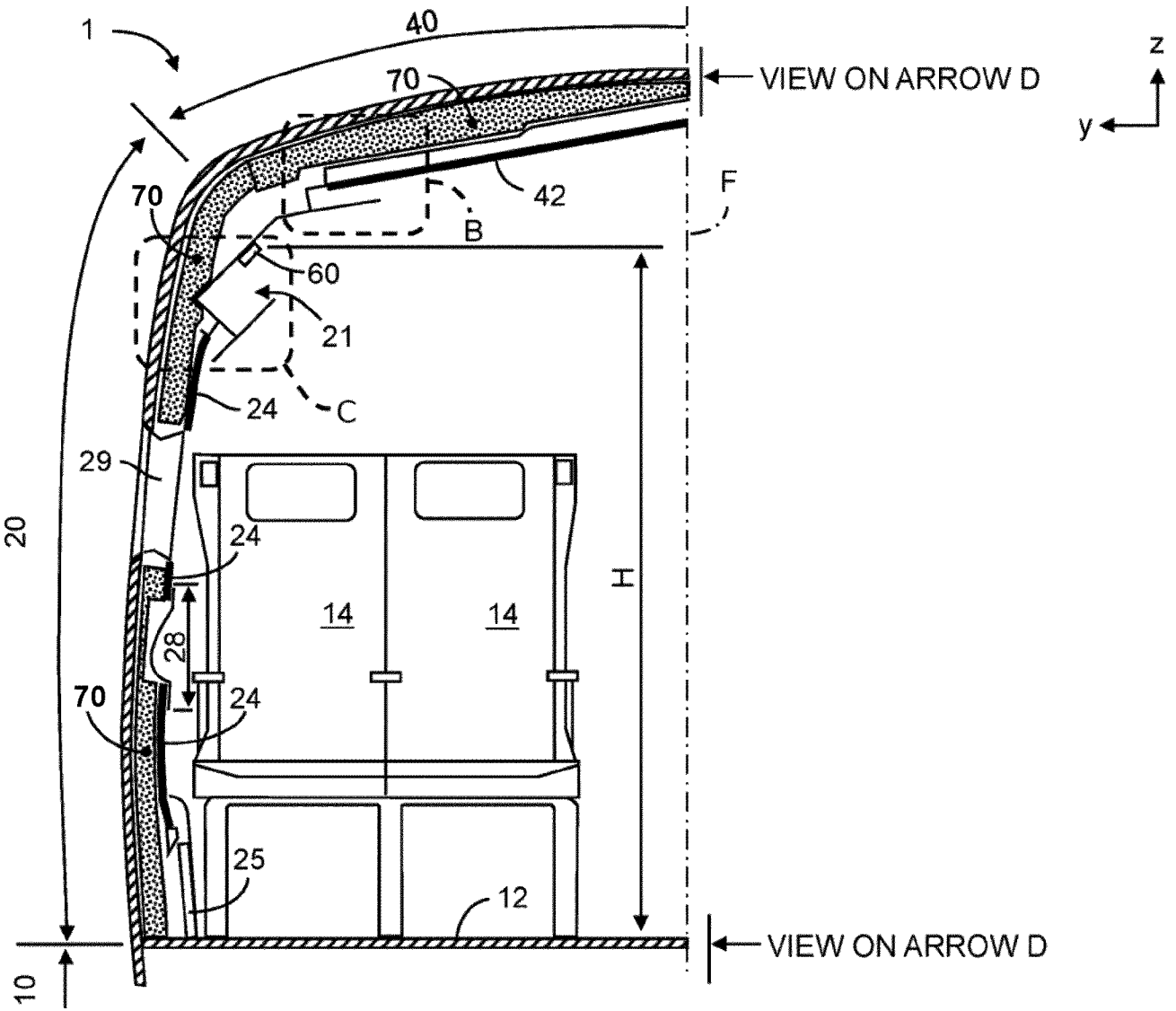
FIG. 2 is a cross-sectional view (a cross-sectional view taken along a line A-A in FIG. 1) intersecting a longitudinal direction of the railway vehicle.

FIG. 1 is a side view showing a railway vehicle, and FIG. 2 is a cross-sectional view (a cross-sectional view taken along a line A-A in FIG. 1) intersecting a longitudinal direction of the railway vehicle. A railway vehicle 1 includes a hexahedral railway vehicle structure including an underframe 10 serving as a floor surface, side structures 20 serving as vehicle side surfaces erected on both end portions of the underframe 10 in the y direction, an end structure 30 erected on an end portion of the underframe 10 in the x direction, and a roof structure 40 serving as a vehicle roof placed on upper end portions of the side structures 20 and the end structure 30, and the railway vehicle 1 includes a pair of bogies 7 that support lower surfaces of both end portions in the x direction of the railway vehicle structure. The bogies 7 support the railway vehicle structure and move along a track 5.

The underframe 10 includes an upper floor 12 on an upper surface of the underframe 10 and seats 14 on an upper surface of the upper floor 12. A side film 24 serving as an interior material is provided on a vehicle inner side of the side structure 20, and similarly, a ceiling film 42 serving as an interior material is provided on a vehicle inner side of the roof structure 40.

A luggage rack portion 21 is provided on a vehicle inner side of the upper end portion in the z direction of the side structure 20. The luggage rack portion 21 is provided with a projector 60 that projects various kinds of information onto the ceiling film 42. The projector 60 is provided at a position of a height dimension H in the z direction from the upper floor 12.

The side structure 20 includes a plurality of windows 29 discretely provided along the x direction of the side structure 20. An armrest portion 28 is provided below the window 29. The armrest portion 28 has a protrusion shape toward a vehicle external side and is provided at substantially the same height as an armrest of the seat 14. A passenger seated on the seat 14 can place an arm by using an enlarged space from the armrest of the seat 14 to a recessed portion on a vehicle inner side of the armrest portion 28.

Figure 3:
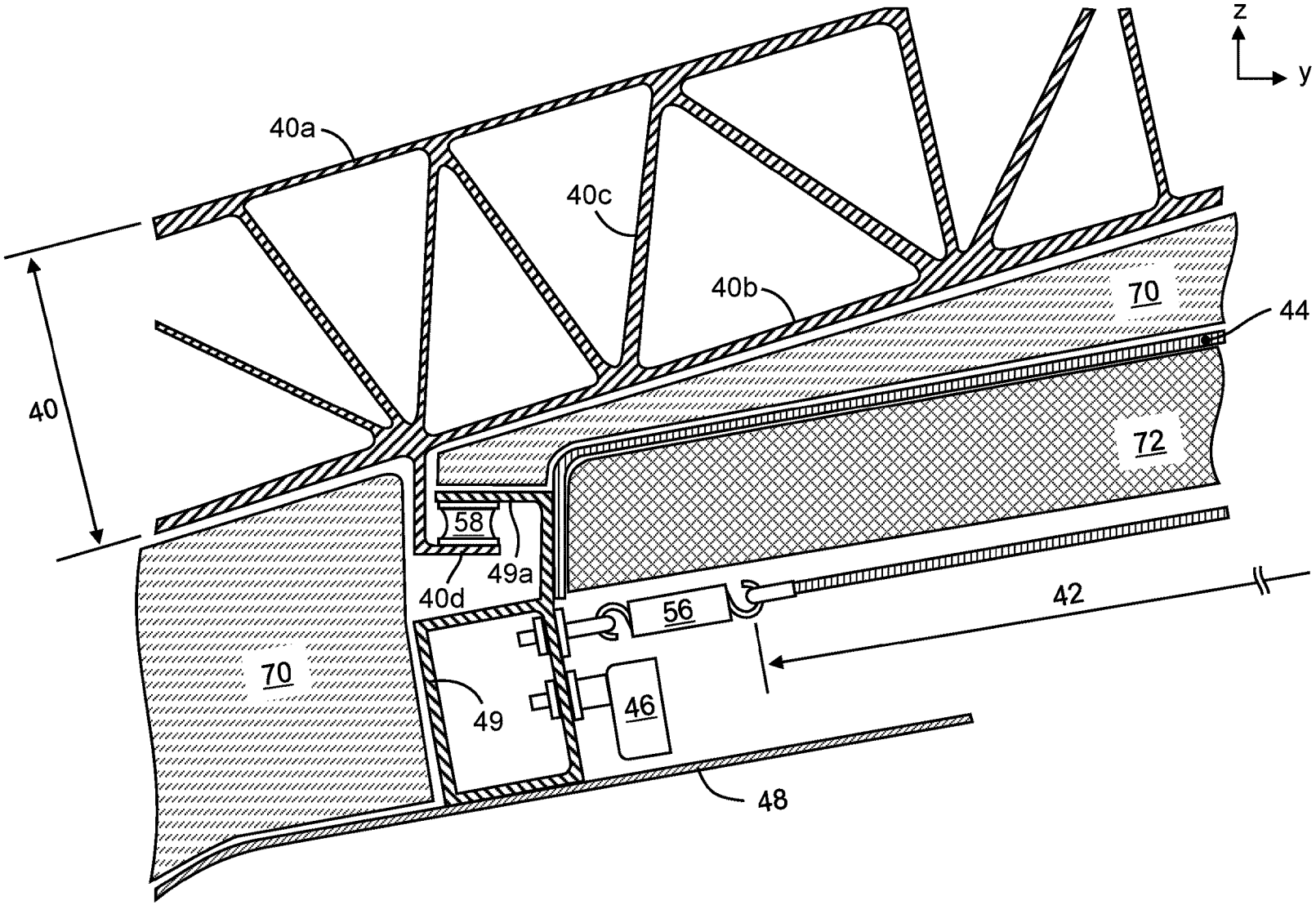
FIG. 3 is an enlarged cross-sectional view (a part B in FIG. 2) showing an end portion in a width direction of a roof structure and intersecting the longitudinal direction of the railway vehicle.

FIG. 3 is a cross-sectional view (a part B in FIG. 2) showing an end portion in a width direction of a roof structure and intersecting a longitudinal direction of the railway vehicle. The roof structure 40 includes a vehicle external side plate 40*a*, a vehicle inner side plate 40*b*, and a plurality of connection ribs 40*c* that connect both of the side plates, and is formed of a hollow extruded member that is extruded in the x direction. A heat insulating material 70, a sound absorbing material support plate 44, a sound absorbing material 72, and the ceiling film 42 are provided in this order on the vehicle inner side of the roof structure 40 from the vehicle inner side plate 40*b*.

The ceiling film 42 is provided in a manner of extending from one end portion to the other end portion in the y direction of the roof structure 40, and a central portion in the y direction of the ceiling film 42 is connected to a central support portion (not shown) supported by a central portion in the y direction of the roof structure 40 in a vibration proof manner, and an end portion in the y direction of the ceiling film 42 is connected to a film and sound absorbing material support portion 49 supported by an end portion in the y direction of the roof structure 40 in a vibration proof manner.

The film and sound absorbing material support portion 49 includes a rectangular cross-section portion having a rectangular cross section intersecting the x direction, an extending portion extending in the z direction from one surface of the rectangular cross-section portion, and a horizontal portion 49*a* extending in the y direction from an end portion in the z direction of the extending portion. The horizontal part 49*a* is supported by a receiving portion 40*d* in a vibration proof manner via a vibration-proof rubber 58, and the receiving portion 40*d* has an L-shaped cross section and is connected to the vehicle inner side plate 40*b* of the roof structure 40.

Both end portions in the y direction of the ceiling film 42 are connected to the film and sound absorbing material support portions 49 via elastic bodies 56 which are, for example, coil springs, and the ceiling film 42 is provided in the railway vehicle 1 in a state of being constantly stretched (in a state of being applied with tension) by tension (elastic force) of the elastic bodies 56. The film and sound absorbing material support portion 49 may include a lamp 46 below the elastic body 56. When the lamp 46 has directivity such that illumination light is directed downward (that is, the lamp 46 does not directly illuminate the ceiling film 42), it is preferable to prevent the illumination of the lamp 46 from affecting a projection image.

Figure 4:
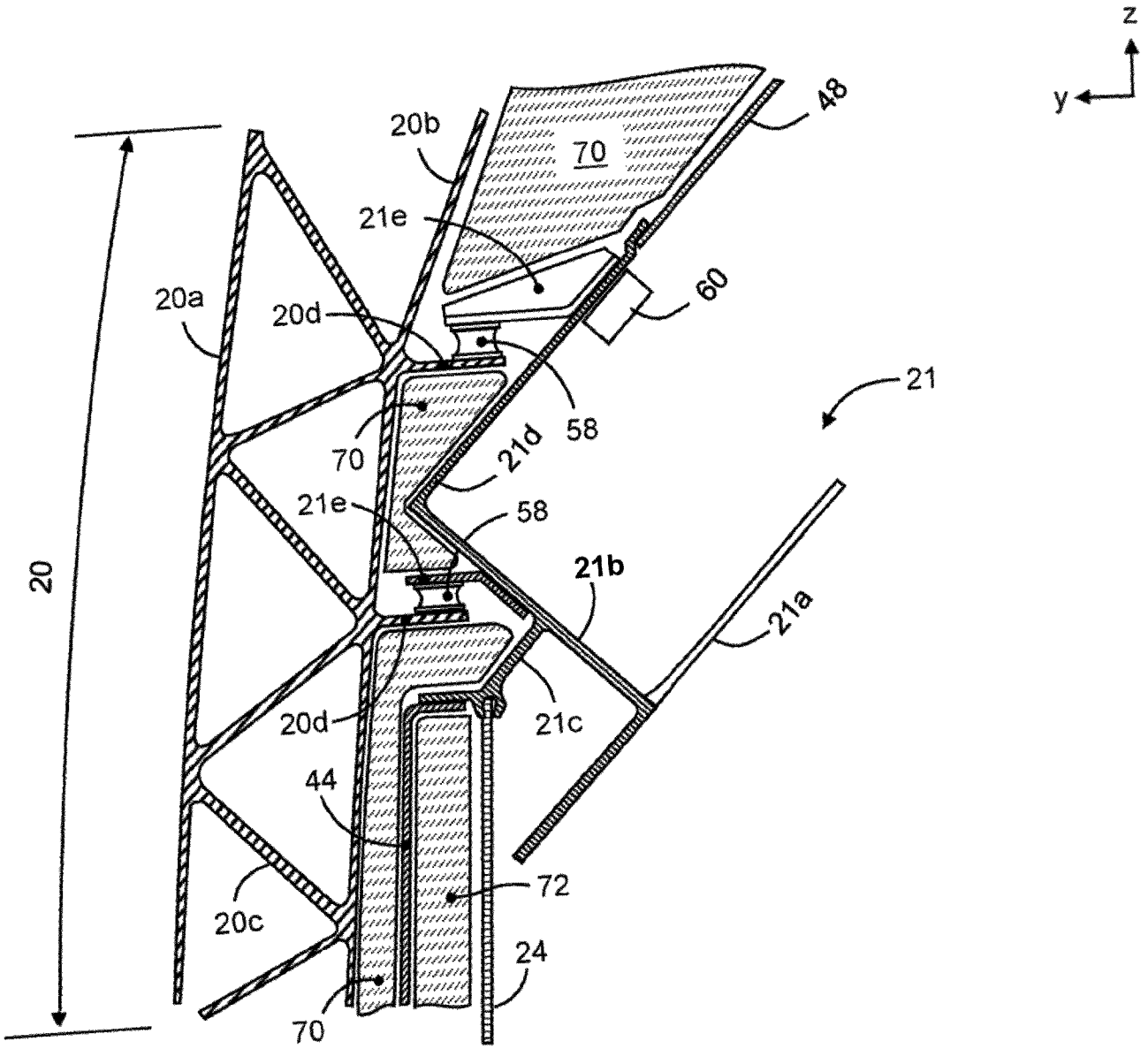
FIG. 4 is an enlarged cross-sectional view (a part C in FIG. 2) showing a luggage rack portion and intersecting the longitudinal direction of the railway vehicle.

FIG. 4 is an enlarged cross-sectional view (a part C in FIG. 2) showing the luggage rack portion and intersecting in the longitudinal direction of the railway vehicle. The side structure 20 is formed of a hollow extruded member that is extruded in the x direction and includes a vehicle external side plate 20*a*, a vehicle inner side plate 20*b*, and a plurality of connection ribs 20*c* that connect both of the side plates. The heat insulating material 70, the sound absorbing material support plate 44, the sound absorbing material 72, and the side film 24 are provided in this order on a vehicle inner side of the side structure 20 from the vehicle inner side plate 20*b*.

The side structure 20 is provided with the luggage rack portion 21 at an upper end portion in the z direction of the side structure 20. The luggage rack portion 21 includes luggage-receiving-portion bottom portions 21*b* for receiving luggage or the like placed on the luggage rack portion 21, luggage-receiving-portion back side panels 21*d* erected on one end edges (a side close to the side structure 20) in the y direction of the luggage-receiving-portion bottom portions 21*b*, and luggage-receiving-portion front side panels 21*a* that are provided in a manner of substantially parallel to the luggage-receiving-portion back side panels 21*d* and are erected on the other end edges (a side close to a center line F of a central portion in the y direction of the railway vehicle 1) in the y direction of the luggage-receiving-portion bottom portions 21*b*. An upper end of each of the luggage-receiving-portion back side panels 21*d* is located higher than an upper end of the luggage-receiving-portion front side panel 21*a*.

In the luggage rack portion 21, a luggage-receiving-portion support portion 21*e* fixed to the luggage-receiving-portion back side panel 21*d* and the luggage-receiving-portion support portion 21*e* fixed to the luggage-receiving-portion bottom portion 21*b* are respectively supported via the vibration-proof rubbers 58 on the side structure 20 in a vibration proof manner by a pair of receiving portions 20*d* extending in a horizontal direction from the vehicle inner side plate 20*b* of the side structure 20.

One end portion of an eaves portion interior panel 48 is connected to an upper end portion in the z direction of the luggage-receiving-portion back side panel 21*d*. The other end portion of the eaves portion interior panel 48 is fixed to a central support portion (not shown) supported in a vibration proof manner by a central portion in the y direction of the roof structure 40.

The luggage-receiving-portion bottom portion 21*b* includes a film and sound absorbing material support portion 21*c* extending in parallel to the luggage-receiving-portion front side panel 21*a* from a central portion in the y direction of the luggage-receiving-portion bottom portion 21*b*. The film and sound absorbing material support portion 21*c* supports the sound absorbing material support plate 44 provided along the side structure 20 and an upper end portion in the z direction of the side film 24.

Lower end portions in a −z direction of the sound absorbing material support plate 44 and the side film 24 are held by a film and sound absorbing material support portion (not shown) supported by a vibration-proof rubber fixed to a vibration-proof rubber receiver provided at a lower end portion in the −z direction of the side structure 20. Although not described in detail, one end portion in the z direction of the side film 24 is connected to the side structure 20 via an elastic body, and is provided in the railway vehicle 1 in a state in which the side film 24 is constantly stretched by tension of the elastic body.

Figure 5:
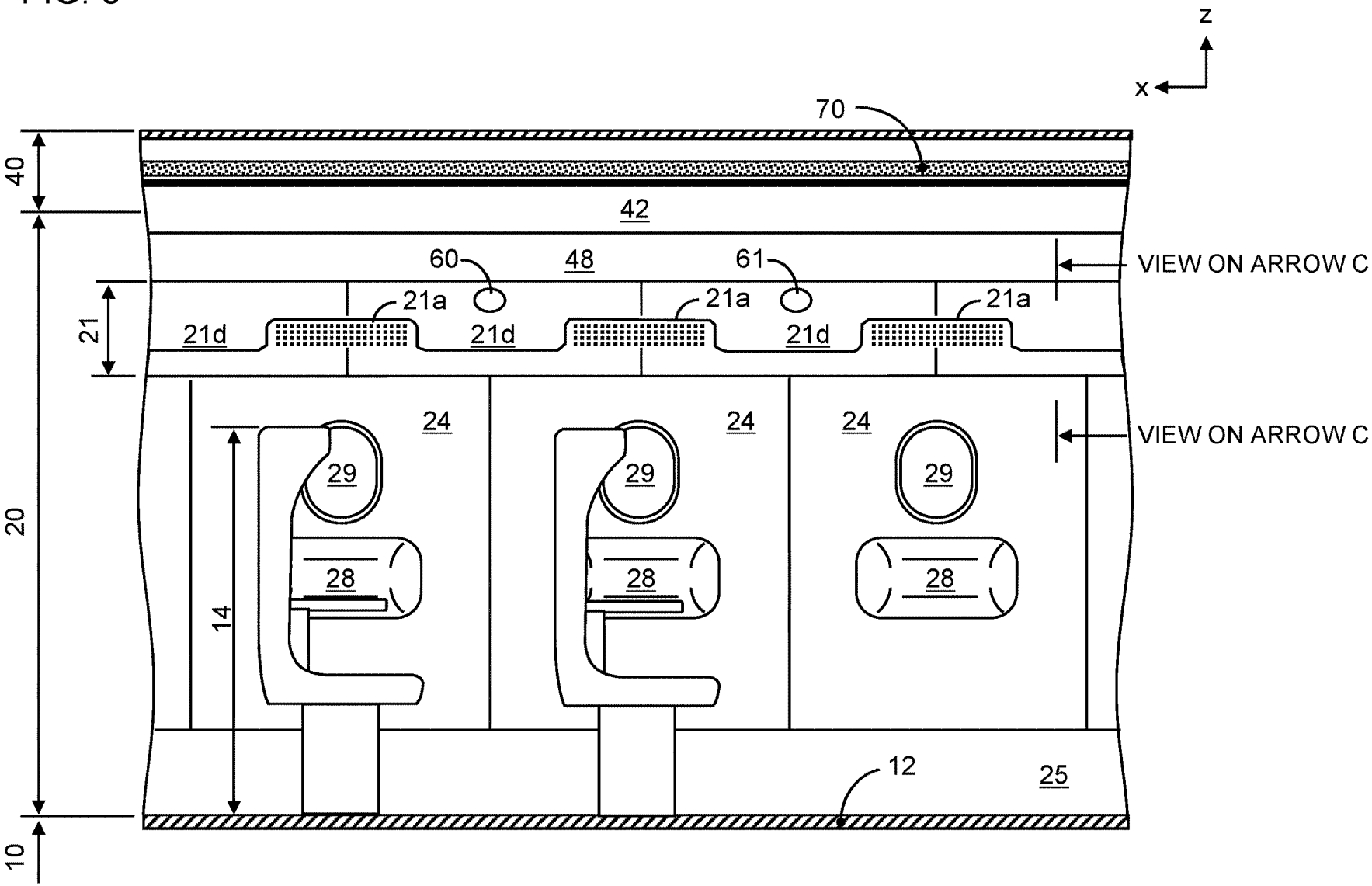
FIG. 5 is a schematic view (a view taken along arrows D in FIG. 2) showing a vehicle inner side of a side structure as viewed from a vertical cross section along a longitudinal direction of a central portion in a width direction of the railway vehicle.

The luggage-receiving-portion front side panels 21*a* are discretely (intermittently) provided only at positions corresponding to the seats 14 along the x direction of the luggage rack portion 21 (see FIG. 5). The projector 60 constituting the in-vehicle display device is provided on the luggage-receiving-portion back side panel 21*d* located between the luggage-receiving-portion front side panel 21*a* adjacent to each other along the x direction of the luggage rack portion 21. Therefore, the projector 60 projects various kinds of information onto the ceiling film 42 serving as a projection surface without blocking the information by the luggage-receiving-portion front side panel 21*a*. It is preferable that a projection center line that connects a center of the projector 60 and a center of a projection image is located in a zy plane.

The railway vehicle 1 may include a plurality of in-vehicle display devices disposed along the x direction of the railway vehicle 1 and including a plurality of projectors 60 near one end portion in the x direction of the luggage rack portion 21, at a central portion in the x direction of the luggage rack portion 21, and near the other end portion in the x direction of the luggage rack portion 21.

Figure 6:
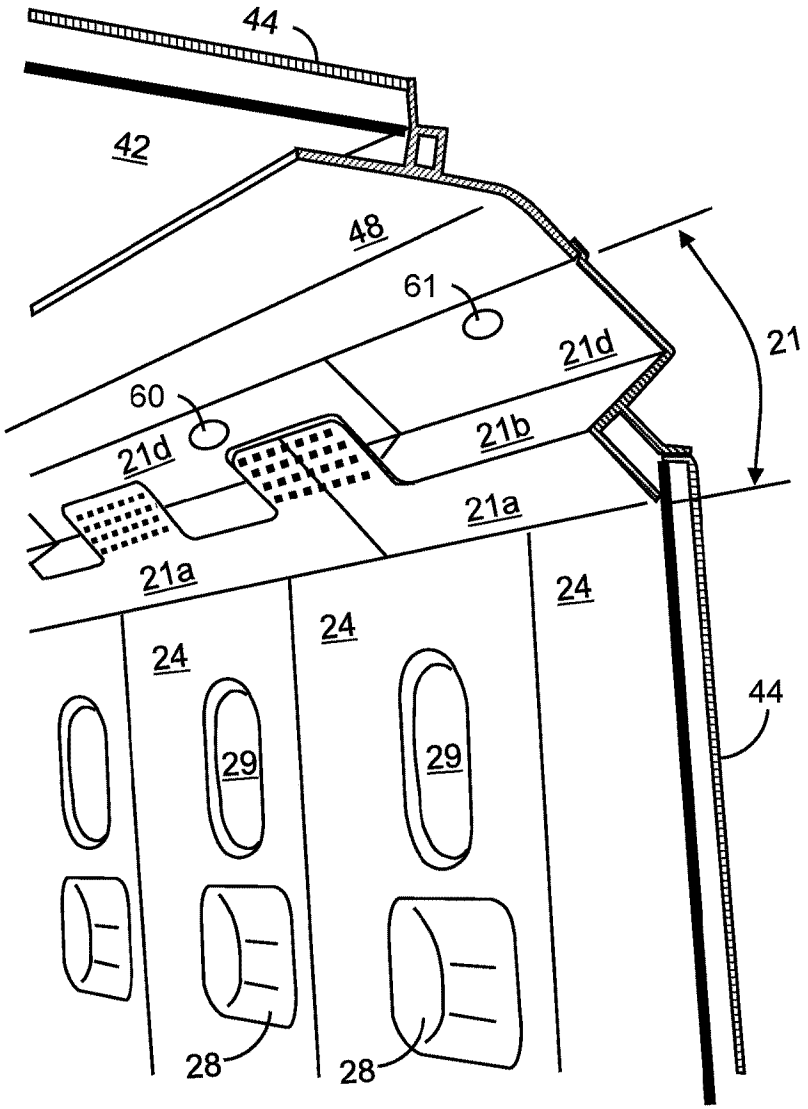
FIG. 6 is a perspective view showing a ceiling, a side interior, and a luggage rack portion at a connection portion between the ceiling and the side interior in the railway vehicle.
Figure 7:
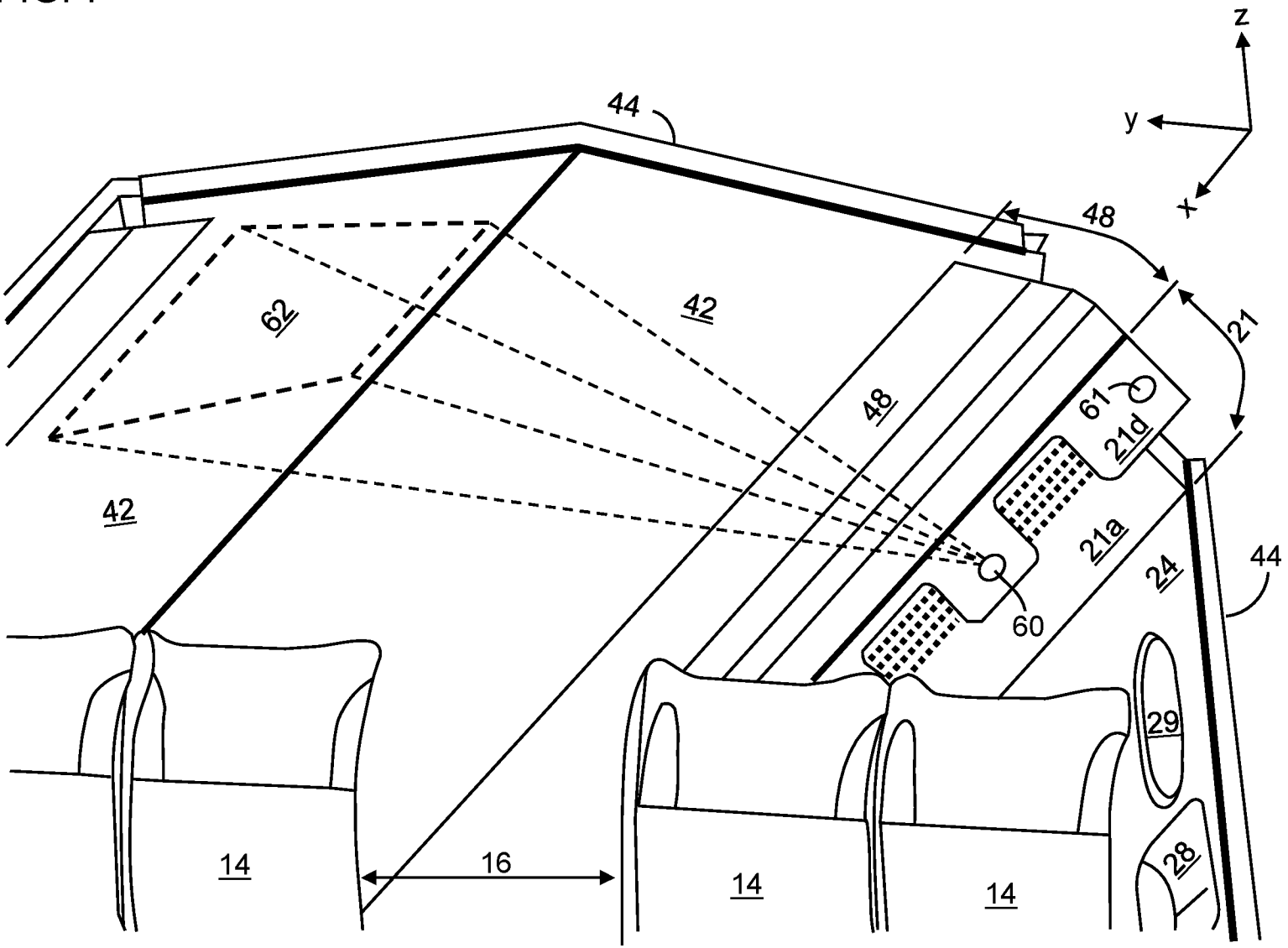
FIG. 7 is a schematic view showing a state in which a projector provided in the luggage rack portion projects an image onto the ceiling.

FIG. 5 is a schematic view (a view taken along arrows D in FIG. 2) showing a vehicle inner side of a side structure as viewed from a vertical cross section along a longitudinal direction of a central portion in a width direction of the railway vehicle. FIG. 6 is a perspective view showing a ceiling, a side interior, and the luggage rack portion at a connection portion between the ceiling and the side interior in the railway vehicle. FIG. 7 is a schematic view showing a state in which the projector provided in the luggage rack portion projects an image onto the ceiling.

The luggage-receiving-portion front side panels 21*a* constituting the luggage rack portion 21 are provided discretely (intermittently) along the x direction of the railway vehicle 1, and the luggage-receiving-portion front side panel 21*a* is not provided at a position corresponding to a position between the seat 14 and the seat 14. The luggage-receiving-portion front side panel 21*a* is provided on the luggage rack portion 21 in such a manner that a part (at least a seat upper surface) or all of the seat 14 is included in a range in the x direction defined by perpendicular lines drawn downward (in the −z direction) from one end portion in the x direction of the luggage-receiving-portion front side panel 21*a* and the other end portion of the luggage-receiving-portion front side panel 21*a*. Accordingly, the line of sight of a passenger seated in the seat 14 is easily directed to an image projected on the ceiling film 42 by the projector 60.

The projector 60 is provided at a portion of the luggage-receiving-portion back side panel 21*d* located between the luggage-receiving-portion front side panel 21*a* and the luggage-receiving-portion front side panel 21*a* that are discretely (intermittently) provided (that is, between the luggage-receiving-portion front side panels 21*a* adjacent to each other in the x direction). This portion is referred to as a front side panel absent portion. A device 61 such as an LED (a lighting device), a speaker (broadcast equipment), and a monitoring (security) camera may be provided at the front side panel absent portion of the luggage-receiving-portion back side panel 21*d* where the projector 60 is not provided. The luggage rack portion 21 may be made of a metal such as an aluminum alloy having a lightweight and a high thermal conductivity.

Further, the luggage rack portion 21 may be implemented as a luggage rack portion module in which a dimension in the x direction of the luggage rack portion 21 is set to a length that can be handled in the railway vehicle 1, and a multifunction receiving portion that can commonly include the projector 60 and the devices 61 may be assembled in advance to the luggage-receiving-portion back side panel 21*d* of the luggage rack portion module.

When the luggage rack portion module is manufactured by outwork (vehicle outside work), the projector 60, the lighting device (the device 61), the speaker (the device 61), and the security camera (the device 61) can be provided in advance in the luggage rack portion module in each multifunction receiving portion. When the luggage rack portion module is fixed to the railway vehicle 1, wires of the projectors 60 and the devices 61 incorporated in advance in the luggage rack portion module may be connected to wires provided in the railway vehicle 1 by a connector.

<Effects>

As shown in FIG. 7, an image including various kinds of information projected from the projector 60 is enlarged and projected on the ceiling film 42, and a passenger seated in the seat 14 can easily see the enlarged projection image. Since a projection surface 62 is the ceiling film 42 having a small number of components and a light weight, it is not necessary to newly prepare a projection surface, and it is possible to provide the railway vehicle 1 including an in-vehicle display device having a small number of manufacturing steps, a light weight, and a large display unit. In this case, the projector 60 preferably performs image processing such as trapezoidal correction so as to prevent distortion of a projected image in accordance with inclination of the ceiling film 42 serving as a projection surface.

Further, tension can be constantly applied to the ceiling film 42 by providing the ceiling film 42 constituting the projection surface 62 via the elastic body 56. Therefore, even when the ceiling film 42 expands and contracts due to aging or the like after the ceiling film 42 is constructed, since tension is constantly applied by the elastic body 56, the ceiling film 42 can be prevented from sagging and wrinkling, and thus an image projected onto the ceiling film 42 is not distorted over a long period of time and the large projection surface 62 with good visibility can be maintained.

Further, since the projector 60 constituting the in-vehicle display device is provided at a height of a dimension H from the upper floor 12 on the luggage rack portion 21 located at a sufficiently high position from the upper floor 12, it is possible to prevent a head of a passenger or the like who walks on a passage 16 from blocking information projected by the projector 60, and thus it is possible to implement the in-vehicle display device with good visibility and high quality. Since the luggage rack portion 21 to which the projector 60 is attached is supported in a vibration manner relative to the side structure 20, the luggage rack portion 21 and the projector 60 can be prevented from vibrating to prevent a situation in which it is difficult to visually recognize a projection image.

Further, since the luggage rack portion 21 is made of a light alloy such as aluminum having a light weight and a high thermal conductivity, heat generated from the projector 60 and the devices 61 can be transferred to the luggage-receiving-portion back side panel 21*d* and dissipated into the air. Accordingly heat of the projector 60 and the devices 61 can be removed, and thus deterioration of the projector 60 and the devices 61 caused by the heat can be prevented.

Further, it is possible to reduce an amount of materials used for the luggage rack portion 21 and promote a weight reduction of the luggage rack portion 21 by providing the luggage rack portion 21 including the luggage-receiving-portion front side panel 21*a* provided discretely (intermittently) along the x direction of the railway vehicle 1.

Furthermore, since luggage such as a bag of a passenger or the like is placed on the luggage rack portion 21 where the luggage-receiving-portion front side panel 21*a* is present, the projector 60 is provided at a front side panel absent portion of the luggage-receiving-portion back side panel 21*d*, so that blocking of an image such as information projected by the projector 60 can be prevented even when luggage (a bag or the like) is placed on the luggage rack portion 21, and thus it is possible to implement an in-vehicle information device having good visibility and high quality.

Furthermore, since the projector 60 is provided at the front side panel absent portion of the luggage-receiving-portion back side panel 21*d*, it is possible to prevent a head, an arm, or the like of a passenger or the like who places luggage (a bag or the like) on or takes off luggage (a bag or the like) from the luggage rack portion 21 from blocking an image such as information projected by the projector 60, and thus it is possible to implement an in-vehicle information device having good visibility and high quality.

Furthermore, since work can be performed by outwork by implementing a luggage rack module, the number of manufacturing steps can be reduced and a common multifunction receiving portion can be provided, accordingly a unified design can be achieved regardless of the projector 60 and the devices 61 provided in the multifunction receiving portion, and thus the appearance of the interior of the railway vehicle 1 can be improved.

According to the invention, it is possible to provide the rail vehicle including the projector-type in-vehicle display device that is provided with the projector and the projection surface, the rail vehicle including the in-vehicle display device that can prevent a crew or the like who walks on a passage between seats from blocking a projection image, that provides good visibility for a passenger or the like, and that has a light weight.

The present specification includes the following disclosure of inventions.

(First Aspect)

A rail vehicle includes:

a roof structure serving as a roof of the rail vehicle;

a side structure serving as a side surface of the rail vehicle;

a luggage rack portion provided along a longitudinal direction of the rail vehicle on a vehicle inner side of the rail vehicle at an upper end portion of the side structure;

a projector provided in the luggage rack portion; and a ceiling film provided on a vehicle inner side of the roof structure and serves as a projection surface onto which an image is projected from the projector.

(Second Aspect)

In the rail vehicle according to the first aspect, the ceiling film is provided in a state in which the ceiling film is constantly stretched by elastic force of an elastic body provided at one end portion of the ceiling film.

(Third Aspect)

In the rail vehicle according to the first or second aspect, the luggage rack portion includes a luggage-receiving-portion bottom portion, a luggage-receiving-portion back side panel erected on one end edge of the luggage-receiving-portion bottom portion, and a luggage-receiving-portion front side panel erected on the other end edge of the luggage-receiving-portion bottom portion.

(Fourth Aspect)

In the rail vehicle according to the third aspect the luggage-receiving-portion front side panels are intermittently provided along the longitudinal direction of the rail vehicle.

(Fifth Aspect)

In the rail vehicle according to the fourth aspect, a seat is disposed within a range in the longitudinal direction defined by one perpendicular line drawn downward from one end portion in a longitudinal direction of the luggage-receiving-portion front side panel and another perpendicular line drawn downward from the other end portion in the longitudinal direction of the luggage-receiving-portion front side panel.

(Sixth Aspect)

In the rail vehicle according to the fourth or fifth aspect, the projector is provided on the luggage-receiving-portion back side panel located between the luggage-receiving-portion front side panels adjacent to each other in the longitudinal direction.

(Seventh Aspect)

In the rail vehicle according to any one of the first to seventh aspects, the luggage rack portion is made of an aluminum alloy.

REFERENCE SIGNS LIST

1: railway vehicle (rail vehicle)
5: track
7: bogie
10: underframe
12: upper floor
14: seat
16: passage
20: side structure
20*a*: vehicle external side plate
20*b*: vehicle inner side plate
20*c*: connection rib
20*d*: receiving portion
21: luggage rack portion (luggage receiving portion)
21*a*: luggage-receiving-portion front side panel
21*b*: luggage-receiving-portion bottom portion
21*c*: film and sound absorbing material support portion
21*d*: luggage-receiving-portion back side panel
21*e*: luggage-receiving-portion support portion
22: side film
25: side lower portion interior panel
28: armrest portion
29: window
30: end structure
40: roof structure
40*a*: vehicle external side plate
40*b*: vehicle inner side plate
40*c*: connection rib
42: ceiling film
44: sound absorbing material support plate
46: lamp
48: eaves portion interior panel
49: film and sound absorbing material support portion
56: elastic body (coil spring)
58: vibration-proof rubber
60: projector
61: device (LED, speaker, and the like)
62: projection surface
70: heat insulating material
72: sound absorbing material
80: passenger
x: rail (longitudinal) direction
y: sleeper (width) direction
z: height direction
F: center line (part)
H: height dimension from upper floor to projector

The invention claimed is:

1. A rail vehicle includes:
a roof structure serving as a roof of the rail vehicle;
a side structure serving as a side surface of the rail vehicle;
a luggage rack portion provided along a longitudinal direction of the rail vehicle on a vehicle inner side of the rail vehicle at an upper end portion of the side structure;
a projector provided in the luggage rack portion; and
a ceiling film provided on a vehicle inner side of the roof structure and serves as a projection surface onto which an image is projected from the projector; and
wherein the ceiling film is provided in a state in which the ceiling film is constantly stretched by elastic force of an elastic body provided at one end portion of the ceiling film.

2. The rail vehicle according to claim 1, wherein
the luggage rack portion includes
a luggage-receiving-portion bottom portion,
a luggage-receiving-portion back side panel erected on one end edge of the luggage-receiving-portion bottom portion, and
a luggage-receiving-portion front side panel erected on the other end edge of the luggage-receiving-portion bottom portion.

3. The rail vehicle according to claim 2, wherein
the luggage-receiving-portion front side panels are intermittently provided along the longitudinal direction of the rail vehicle.

4. The rail vehicle according to claim 3, wherein
a seat is disposed within a range in the longitudinal direction defined by one perpendicular line drawn downward from one end portion in a longitudinal direction of the luggage-receiving-portion front side panel and another perpendicular line drawn downward from the other end portion in the longitudinal direction of the luggage-receiving-portion front side panel.

5. The rail vehicle according to claim 3, wherein
the projector is provided on the luggage-receiving-portion back side panel located between the luggage-receiving-portion front side panels adjacent to each other in the longitudinal direction.

6. The rail vehicle according to claim 1, wherein
the luggage rack portion is made of an aluminum alloy.

* * * * *